US007913622B2

(12) United States Patent
Pitz et al.

(10) Patent No.: US 7,913,622 B2
(45) Date of Patent: Mar. 29, 2011

(54) METHOD FOR DRYING A PRINTING INK ON A PRINTING SUBSTRATE IN A PRINTING PRESS, AND A PRINTING PRESS

(75) Inventors: Heiner Pitz, Heidelberg (DE); Axel Hauck, Karlsruhe (DE); Werner Anweiler, Bruchsal (DE); Peter Hachmann, Dossenheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 12/221,543

(22) Filed: Aug. 4, 2008

(65) Prior Publication Data

US 2008/0295719 A1 Dec. 4, 2008

Related U.S. Application Data

(63) Continuation of application No. 10/813,937, filed on Mar. 31, 2004, now abandoned.

(30) Foreign Application Priority Data

Apr. 9, 2003 (DE) ..... 103 16 472

(51) Int. Cl.
*B41F 23/04* (2006.01)
*B41F 35/00* (2006.01)

(52) U.S. Cl. ..... 101/487; 101/424.1

(58) Field of Classification Search ..... 101/416.1, 101/424.1, 487
See application file for complete search history.

(56) References Cited

U.S. PATENT DOCUMENTS

| | | | |
|---|---|---|---|
| 3,711,317 | A | 1/1973 | Bleier |
| 4,991,506 | A | 2/1991 | Rodi |
| 5,115,741 | A | 5/1992 | Rodi |
| 5,668,584 | A | 9/1997 | Broder et al. |
| 6,026,748 | A | 2/2000 | Reed et al. |
| 6,401,358 | B1 | 6/2002 | Bar et al. |

(Continued)

FOREIGN PATENT DOCUMENTS

| | | |
|---|---|---|
| DE | 388124 | 1/1924 |

(Continued)

OTHER PUBLICATIONS

Stefan Becker, Monomere und polymere Rylenfarbstoffe als funktionelle Materien, Johannes Gutenberg Universitaet Mainz, 2000.

*Primary Examiner* — Ren Yan
(74) *Attorney, Agent, or Firm* — Davidson, Davidson & Kappel, LLC

(57) ABSTRACT

A method for drying a printing ink (114) on a printing substrate (14) in a printing press (30), and a printing press (30). The printing substrate (14) is moved along a path (16) through the printing press (30) and printed on by at least one printing ink (114) at a first position (18) of the path (16). At a second position (124) of the path (16), in a conditioning apparatus, a treatment agent (118) is applied to the printing substrate (14) to accelerate the drying of the printing ink (114) on the printing substrate (14) and includes, in particular, an infrared absorber which has an absorption wavelength that is essentially resonant to the wavelength of the light (12) of the radiant energy source (10). The printing substrate (14) may be dried by the action of radiant energy at a chronologically later point in time, at at least one third position (116) of the path (16), by a drying device, in particular by a narrow-band radiant energy source (10).

5 Claims, 4 Drawing Sheets

U.S. PATENT DOCUMENTS

| | | | |
|---|---|---|---|
| 6,471,430 | B1 | 10/2002 | Gaus et al. |
| 6,802,256 | B1 | 10/2004 | Koch |
| 2002/0112628 | A1 | 8/2002 | Irick |
| 2002/0148386 | A1 | 10/2002 | Woosman et al. |
| 2003/0010251 | A1 | 1/2003 | Woosman et al. |
| 2003/0020795 | A1 | 1/2003 | Bar et al. |
| 2003/0066452 | A1 | 4/2003 | Jung et al. |
| 2003/0071863 | A1 | 4/2003 | Doberenz |
| 2003/0075063 | A1 | 4/2003 | Pitz |
| 2003/0108689 | A1 | 6/2003 | Tan et al. |
| 2004/0189769 | A1 | 9/2004 | Wilbur et al. |

FOREIGN PATENT DOCUMENTS

| | | | |
|---|---|---|---|
| DE | 609479 | | 2/1935 |
| DE | 1936467 | | 9/1970 |
| DE | 2161322 | | 6/1973 |
| DE | 3390425 | | 6/1984 |
| DE | 21 61 322 | C3 | 1/1985 |
| DE | 4435077 | | 11/1995 |
| DE | 10022037 | | 11/2001 |
| DE | 10107682 | | 8/2002 |
| DE | 10149009 | | 4/2003 |
| DE | 10234076 | | 4/2003 |
| EP | 0355473 | | 10/1993 |
| FR | 2086751 | | 12/1971 |
| JP | 63319192 | | 12/1988 |
| JP | 07278795 | | 10/1995 |
| JP | 09119532 | | 5/1997 |
| WO | WO 84/02665 | | 7/1984 |
| WO | WO 99/37484 | | 7/1999 |
| WO | WO 99/42774 | | 8/1999 |
| WO | WO 00/14017 | | 3/2000 |

METHOD FOR DRYING A PRINTING INK ON A PRINTING SUBSTRATE IN A PRINTING PRESS, AND A PRINTING PRESS

This application is a continuation of U.S. patent application Ser. No. 10/813,937 filed Mar. 31, 2004 and hereby incorporated by reference herein. Priority to German Patent Application No. 103 16 472.3, filed Apr. 9, 2003 and hereby incorporated by reference herein, is claimed.

The present invention is directed to a method for drying a printing ink on a printing substrate in a printing press, at least one printing ink being used to print on the printing substrate at a first position of a path along which the printing substrate is moved through the printing press. The present invention is also directed to a printing press having at least one print unit and one drying device at a position along the path of a printing substrate through the printing press, downstream from the print unit, for supplying energy to the printing substrate.

BACKGROUND INFORMATION

Depending on the type of printing ink and the underlying special drying process, different types of printing press installations are known, in particular planographic presses, such as lithographic presses, rotary presses, offset presses, flexographic presses, and the like, which process sheet- or web-shaped printing substrates, in particular paper, cardboard, carton, and the like, which initiate or promote an adhesion of the ink to the printing substrate, in that radiant energy, in particular in the form of light, is fed to the printing ink located on the printing substrate.

The so-called UV inks cure by polymerization, which is triggered by photoinitiation using ultraviolet light. On the other hand, solvent-containing printing inks, which are able to undergo both a physical as well as a chemical drying process, are very common. Physical drying encompasses the evaporation of solvents and the diffusion into the printing substrate (absorption), while chemical drying or oxidative drying is based on the polymerization of the oils, resins, binding agents, or the like, contained in the ink formulations, possibly with the co-action of atmospheric oxygen. The drying processes are generally dependent on one another, since the absorption of the solvents effects a separation between solvents and resins within the binding agent system, so that the resin molecules come closer together and possibly polymerize more easily. Moreover, the drying process is very dependent upon the type of printing substrate, for example whether there is a first coat or a top coat when paper is the raw material used.

Depending on the particular print job, the prescribed combinations of printing substrate and printing ink are often not coordinated with respect to the drying process, so that it is time-consuming to dry a processed printing substrate. It may be that the risk of printing ink being set off in delivery can be countered by increasing the spray powder application in a stack, however this increases the environmental impact. Moreover, one still has to contend with considerable delays until the printed products or signatures can be further processed.

From the German Unexamined Patent Application 1 936 467, related to U.S. Pat. No. 3,711,317 both of which are hereby incorporated by reference herein, it is known, for example, that a printing substrate or printing carrier can be provided with a substance that promotes drying, i.e., a catalyst, in the printing carrier material or as a pigment coating, so that when the printing ink is applied to the printing substrate, the printing ink cures or dries. The disadvantage here is that a direct, substantially uncontrolled reaction takes place immediately during the printing process. Thus, for example, printing ink can even dry in an unwanted manner on the printing cylinder and soil the print unit.

The European Patent 0 355 473 A2, related to U.S. Pat. No. 4,991,506, both of which are incorporated by reference herein, for example, describes a device for drying printed products, which includes a radiant energy source in the form of a laser. The radiant energy is transmitted to the surface of the printing substrates, which are conveyed along a path through the printing press by a transport device, at a position between individual print units or following the last print unit, before or in the delivery. In this context, the radiation source can be a laser in the ultraviolet range for UV inks or a laser light source for heating solvent-containing printing inks. The radiant energy source is configured outside of the printing press to prevent parts of the press from being undesirably heated because of dissipation heat that cannot be avoided or that cannot be shielded. Here, the disadvantage is, however, that an additional system component must be separately provided for the printing press.

To remove solvents from a solvent-containing printing ink and/or water, it is also known from U.S. Pat. No. 6,026,748, for example, for a printing press to be provided with a drying device having infrared lamps, which emit short-wavelength infrared light (near infrared) or medium-wavelength infrared light. The emission spectrum of lamp light sources is broadband and, therefore, offers a multiplicity of wavelengths. The drawback of such drying devices in the infrared region is that a considerable proportion of the energy absorption takes place in the paper, the ink only being indirectly heated. A rapid drying is only possible by inputting enough energy. In the process, however, there is the danger, inter alia, of the printing substrate drying out unevenly and becoming warped.

In electrophotographic printing technology, it is known, for example, from the German Patent Publication No. DE 44 35 077 A1, hereby incorporated by reference herein, to fix toner to a recording medium by using radiant energy in the near infrared region emitted by diode lasers. A narrow-band light source is used to heat the toner particles, in order to melt them, to form them into a colored coating, and to anchor them to the surface of the recording medium. Since in this spectral region, a considerable number of common paper grades have broad absorption minima, it is possible that a predominant share of the energy is directly absorbed into the toner particles.

Moreover, it is known from the German Patent Publication No. 101 07 682 A1, hereby incorporated by reference herein, that an electrophotographic printing press or copy machine can have a plurality of fixing devices for toner, each of the fixing devices having a wavelength range of electromagnetic radiation which corresponds to a maximum absorption wavelength of the type of toner assigned to this fixing device, but exhibiting no or only little absorption at absorption wavelengths of other types of toner.

However, the simple knowledge of the window in the paper absorption spectrum cannot be directly exploited in printing technology that uses solvent-containing printing inks, since, as described above, there are other underlying chemical and/or physical drying processes. In the context of the present invention, the concept of solvent-containing printing ink connotes, in particular, inks whose solvent constituents may be of an aqueous or organic nature, which are derived from binding agent systems, which are able to be oxidatively, ionically or radically polymerized. An energy input for drying solvent-containing printing inks is intended to assist or promote the effect of evaporation of the solvent and/or the effect of absorption into the printing substrate and/or the effect of polymerization, unwanted secondary effects, such as a too intense heating of the solvent-containing printing ink, which can lead to a breakdown of components, or overheating of the solvent, being avoided at the same time. It is not intended for the energy input to be introduced just for melting particles, as in the case of fixing the toner.

The prior German Patent Application DE 102 34 076.5, related to U.S. Patent Application No. 2003/0075063 and hereby incorporated by reference herein, describes admixing an infrared absorber—a substance which absorbs in the near infrared spectral region—to a printing ink to be used for printing in a print unit. A narrow-band radiant energy source, preferably a laser light source, configured downstream from the printing nip, is used to illuminate the printing ink on the printing substrate. Supplying light of one wavelength that is essentially resonant to an absorption wavelength of the infrared absorber, effects, renders possible, or promotes an energy input into the printing ink in a way that dries the printing ink. The wavelength of the radiant energy source and the absorption wavelength of the infrared absorber are selected in such a way that, at the same time, the wavelength used is not resonant to water, so that the energy input into the printing substrate is reduced or avoided.

SUMMARY OF THE INVENTION

An object of the present invention is to devise a method for drying a printing ink on a printing substrate in a printing press, as well as a printing press, which will facilitate the drying of printing ink on the printing substrate used for printing in the printing press.

In accordance with the present invention, the method for drying a printing ink on a printing substrate in a printing press includes at least the following steps: The printing substrate is conveyed along a path through the printing press. At a first position of the path, at least one printing ink, in particular a solvent-containing printing ink, is printed on the printing substrate. At a second position, a treatment agent is applied to the printing substrate to accelerate the drying of the printing ink on the printing substrate. In other words, the treatment agent is used as a catalyst to accelerate the drying of the printing ink on the printing substrate or to accelerate the absorption of energy, in particular as a direct catalyst, which reduces the energy absorption required for drying the printing ink.

The use of a treatment agent advantageously eliminates the need for modifying the formulations of the printing inks, in particular of the solvent-containing printing inks, used to accelerate the drying. For that reason, standard printing inks may be used. The dosage and composition of the treatment agent is to be selected as a function of the printing substrate material, of the printing ink to be used in printing, and of the processing parameters, application parameters, or process parameters. The optimal goal is a maximum possible drying of the printing ink on the printing substrate as soon as the printing substrate exits the printing press, thus upon delivery of sheet-type printing substrates or, in the case of web-shaped printing substrates, upon entry into the folder. It is advantageously possible to adapt the particular treatment agent to the printing substrate used; the speed of action of the treatment agent may be adjusted to the properties of the printing substrate, the printing press, and the printing inks in a manner that is specific to processing parameters.

Moreover, the printing substrate may be dried by the action of radiant energy at a chronologically later point in time, at at least one third position of the path. At this third position in particular, the treatment agent accelerates the drying of the printing ink.

In a first embodiment of the method, the printing substrate may pass the first position chronologically before the second position, and the treatment agent is applied in the form of a coating, for example as an added component in a commercial protective varnish. In a second embodiment of the method, the printing substrate may pass the first position chronologically after the second position, and the treatment agent is applied in the form of a primer coating, for example as an added component of a commercial primer paste.

The treatment agent may also be a catalyst, in particular a catalyst that is directly effective for the energy absorption, or a reaction initiator. In other words, on the one hand, prior to application of the printing ink, the treatment agent may act on the printing substrate in such a way that a subsequent drying is facilitated, accelerated, or simplified. On the other hand, alternatively or additionally thereto, the treatment agent may act on the applied printing ink or on the printing ink to be applied in such a way that its drying is facilitated, accelerated, or simplified. The treatment agent may have a switching or triggering function: Its action may be such that the effect on the drying is first triggered in response to the treatment agent interacting with the introduced energy. In other words, the treatment agent may be such that its effectiveness first unfolds with a time delay. The treatment agent may be such that it neither chemically changes components of the printing ink nor additives in the printing ink. In other words, the treatment agent effects acceleration of the energy absorption directly, not indirectly by a change in the printing ink or in the printing ink additives.

The treatment agent may be or include, in particular, a siccative or an alkaline solution, especially a metal hydroxide in aqueous solution, for example sodium hydroxide solution or potassium hydroxide solution, or a binding agent.

In one preferred embodiment of the method according to the present invention, at at least the third position of the path, the printing substrate is illuminated with light from a narrow-band radiant energy source. The treatment agent then includes an infrared absorber, which has an absorption wavelength that is essentially resonant to the wavelength of the light emitted by the narrow-band radiant energy source. Examples of infrared absorbers are described in German Application No. DE 102 34 076.5 already mentioned above. This document DE 102 34 076.5, and related U.S. Patent Application No. 2003/0075063, are incorporated herein by reference. Another example of an infrared absorber is indium zink oxide, a substance that is used in varnish systems. Other infrared absorbers are described in the following documents: DE 100 22 037 A1, WO 00/14017, JP-A-07278795 and JP 63319192, as well as in the dissertation "Monomere und polymere Rylenfarbstoffe als funktionelle Materialien" [Monomeric and Polymeric Rylene Dyes as Functional Materials] by S. Becker, Department of Chemistry and Pharmacy, Johannes Gutenberg University, Mainz, 2000, all of which are also incorporated by reference herein.

The treatment agent may include an infrared absorber (also referred to as infrared absorbing material). A coupling of light into the printing ink and/or an absorption of the radiant energy in the printing ink is carried out, rendered possible, promoted, improved, or facilitated by the infrared absorber which, as primer coating or coating, is in contact with the printing ink on the processed printing substrate. In the context of this description of the present invention, to simplify the language, one only speaks of promoting, and this is intended to mean all gradations in the action of the infrared absorber, as indicated in interactions or as alternatives. The energy input at the third position, which may result in the generation of heat, leads to an accelerated drying of the printing ink. On the one hand, a high temperature may be briefly produced in the printing ink (in the ink film) on the printing substrate, on the other hand, chemical reactions may be excited or initiated in some instances as a function of the composition of the printing ink. The infrared absorber may also be described as infrared absorbing material, infrared absorber, infrared absorber substance, or the like. In this context, the infrared absorbing material preferably has the property of exhibiting only little or even no absorption in the visible region of wavelengths, so that the ink imprint of the printing ink is influenced or changed only little or even not at all.

Applying an infrared absorber to cover the whole surface of a printing substrate requires a very good translucency of the infrared absorber in the visible spectral region. Of course, it is not possible to correct a printing ink location being shifted by an infrared absorber to non-image areas. It is, therefore, advantageous to use an infrared absorber, which, upon application, is, in fact, slightly idiochromatic in the visible spectral region, but loses this characteristic at the latest during the drying process, i.e., when interacting with the acting radiant energy. An example of a class of infrared absorbers and specific examples of such infrared absorbers are described in the US2002/0148386A1, whose disclosure is hereby incorporated herein by reference.

It is advantageously possible to attain a relatively high input of energy directly into the printing ink, especially solvent-containing printing ink, in particular assisted by an infrared absorber in the printing substrate, in a primer coating or in a coating, without any unwanted energy input into the printing substrate. This is due to the fact that, on the one hand, the light cannot be absorbed directly by the printing substrate and, on the other hand, the energy absorbed by the ink film is distributed after fractions of seconds to the ink and printing substrate. The heat-absorption capacity and the quantitative proportions are distributed here in such a way that the ink film is able to be briefly heated, before the entire printed sheet undergoes a homogeneous, moderate temperature increase. This reduces the total required energy input. The selective energy input may be assisted in particular by radiating a wavelength that is resonant or quasi-resonant to absorption lines of one component of the printing ink or to one absorption line or one absorption maximum of an infrared absorber substance in the printing ink. The radiant energy is absorbed in the printing ink at a rate of more than 30%, preferably 50%, in particular 75%, and even at a rate of more than 90%.

Moreover, by avoiding the absorption of energy in water, the drying required for the printing substrate is reduced. This is advantageous since, inter alia, the size or format of a printing substrate is altered when it is dried. Because of the so-called swelling process, the format of the printing substrate varies as a function of its drying state or of its moisture content. The swelling process between individual print units necessitates different printing form formats in the individual print units. A change in the moisture content between the print units due to the influence of a radiation-induced drying, resulting in deviations that are only able to be determined in advance and corrected with substantial outlay, is avoided when the method of the present invention is used to dry the printing ink.

In other words, the method according to the present invention makes it possible for the printing ink, in particular solvent-containing printing ink, to be dried on the printing substrate, without influencing its drying-out process too greatly.

At this point, it is also noted that, given an application of a treatment agent, in particular of an infrared absorber, over a large surface area, the printing substrate is able to be homogeneously heated or tempered independently of the print image or print subject, so that deformation or warping of the printing substrate may be avoided.

The drying method according to the present invention may be advantageously used in a print unit having a drying device, as is described in this document. In particular, the emission from a radiant energy source of the drying device and the absorption of the infrared absorber may be specified, adjusted, or provided to match one another along the lines of the present invention. In other words, the radiant energy source should emit one wavelength that corresponds to the absorption of the infrared absorber, or a plurality of wavelengths that correspond to the absorption of the infrared absorber, in particular only this one or this plurality of wavelengths. The light emitted by the radiant energy source is thus quite preferably quasi-resonant, substantially resonant, in particular resonant to an absorption maximum of the infrared absorber, so that the absorption maximum of the infrared absorber conforms to the best possible degree with the emission maximum of the radiant energy source. In the emission region of the radiant energy source, the absorption spectrum of the infrared absorber used exhibits at least 50%, preferably at least 75%, in particular at least 90% of the absorption maximum of the infrared absorber. An infrared absorber may have one or more local absorption maxima.

Alternatively or in addition thereto, the wavelength of the light may not be resonant to the absorption wavelengths of water ($H_2O$). In the context of the present invention, non-resonant to the absorption wavelengths of water is understood to mean that the absorption of the light energy by water at 20° Celsius is not stronger than 10.0%, in a preferred variant, not stronger than 1.0%, in particular is less than 0.1%. In connection with the inventive idea, the radiant energy source emits only a very low-intensity light, preferably no light at all which is resonant to the absorption wavelengths of water ($H_2O$).

In one advantageous embodiment, the radiant energy source is a narrow-band source: In this case, the radiant energy source may emit, for example, up to ±50 nm width, preferably less than ±50 nm width about a wavelength; it may also be a question of one or more individual spectroscopically narrow emission lines. In addition, in one advantageous embodiment, the emission maximum of the narrow-band radiant energy source or the wavelength of the radiant energy is between 700.00 nm and 3000.00 nm, preferably between 700.00 nm and 2500.00 nm, in particular between 800.00 nm and 1300.00 nm, in one partial region of the so-called window in the paper absorption spectrum. Of particular advantage is an emission at 870.00 nm±50.00 nm and/or 1050.00 nm±50.00 nm and/or 1250.00 nm±50.00 nm and/or 1600.00 nm±50.00 nm.

The present invention is also based on the realization that absorption bands of water contribute to the absorption spectrum of paper. The typical water content of printing substrates in waterless (damping solution-free) planographic printing inherently leads to undesired, often even unacceptably strong energy absorption in the printing substrate. This absorption is even more pronounced in planographic printing where damping solutions are used. Too great of an energy input into the printing substrate may therefore be avoided by the radiation of one wavelength that is not resonant to an absorption line or absorption band (absorption wavelength) of water. In accordance with the Heitran database, at a temperature of 296 K, in 1 m absorption section, and given 15000 ppm of water, the following absorption by water, more precisely by water vapor results: at 808 nm, less than 0.5%; at 870±10 nm, less than 0.01%; at 940±10 nm, less than 10%; at 980±10 nm, less than 0.5%; at 1030±30 nm, less than 0.01%; at 1064 nm, less than 0.01%; at 1100 nm, less than 0.5%; and at 1250±10 nm, less than 0.01%. If one considers a 1 $m^2$ surface of the printing substrate, in particular of the paper, and a clearance of 1 m above, then, at an absolute humidity of 1.5%, the air contains a volume of water of about 12 g. As long as in one embodiment of the device according to the present invention, the light source is not further than 1 m away from the printing substrate, and the absolute humidity is not clearly more than 1.5%, the above-indicated absorptions by water and/or water vapor are not exceeded. There may be an additional absorption by the moisture content of the printing substrate in the case that the light penetrates through the ink film into the printing substrate, or by damping solutions that have been transferred by the printing process to the sheet.

The treatment agent may absorb different wavelengths in dependence upon functional groups of its individual components. Using the device according to the present invention, light, preferably light in the near infrared, is fed to the treatment agent situated on the printing substrate, in the planographic press, while avoiding water-absorption wavelengths, for example by radiating only a few wavelengths from a light source emitting one line spectrum.

In accordance with the present invention, a printing press having at least one print unit at a first position along a path of a printing substrate through the printing press, and having one drying device at a third position along the path, downstream from the print unit, for supplying energy to the printing substrate, is suited for implementing a drying method in accordance with this description: A printing press according to the present invention includes at one further second position upstream from the drying device, a conditioning apparatus for applying a treatment agent which accelerates the drying of the printing substrate at the third position. Depending on the system, the conditioning apparatus may also be described as a treatment-agent primer unit or treatment-agent coating unit.

In one advantageous embodiment, the conditioning apparatus is designed to allow an application of treatment agent from both sides onto the printing substrate. In one first variant, the conditioning apparatus may be configured as a separate processing unit of a printing press. In an alternative second variant, the conditioning apparatus is modularly designed as a slide-in unit for a print unit.

In one preferred embodiment, the drying device includes a narrow-band radiant energy source which emits light of one wavelength in the near infrared region. To achieve the most narrow-band emission possible, at the same time maintaining a high spectral power density, the radiant energy source is preferably a laser. Alternatively thereto, a broadband light source, such as an infrared carbon radiator, having a suitable filter system may also be used, so that the result is a narrow-band radiant energy source in combination. In particular, the filter may be an interference filter. For the spatial integration within the planographic press, the laser is preferably a semiconductor laser (diode laser) or a solid-state laser (titanium sapphire, erbium glass, Nd:YAG, Nd-glass or the like). A solid-state laser may preferably be optically pumped by diode lasers. The solid-state laser may also be a fiber laser or optical fiber laser, preferably a ytterbium fiber laser, which is able to supply 300 to 700 W optical power at the work station at 1070 nm to 1100 nm. Lasers of this kind may also be tunable on a limited scale. In other words, the output wavelength of the lasers is variable. As a result, it is possible to tune to a desired wavelength, for example resonantly or quasi-resonantly to an absorption wavelength of a component in the printing ink, in particular to an infrared absorber substance in the printing ink.

In connection with the device according to the present invention, diode lasers or semiconductor lasers are especially advantageous, since they may be used without any special beam-forming optics for purposes of supplying radiant energy to a printing substrate. The light leaving the resonator of a semiconductor laser is strongly divergent, so that the light beam produced widens with increasing distance from the outcoupling mirror. An imaging optics may also be provided, however, in particular one suited for focusing the emitted light at the printing substrate.

In one advantageous embodiment, the print unit according to the present invention has a number of laser light sources which are arranged in a one-dimensional or a two-dimensional field (locally curved, globally curved or flat), or in a three-dimensional field, and whose light strikes the printing substrate at a number of positions. Using a number of individual laser light sources for individual regions on the printing substrate lowers the maximally required output power of the laser light sources. Typically, laser light sources having a low output power are less expensive and have a longer service life. Moreover, generation of unnecessarily high dissipation heat is prevented. The radiant energy per surface area introduced by the supplying of light is between 100 and 10,000 mJ per $cm^2$, preferably between 100 and 1,000 mJ per $cm^2$, in particular between 200 and 500 mJ per $cm^2$. The printing substrate is irradiated for a time duration of between 0.01 ms and 1 s, preferably between 0.1 ms and 100 ms, in particular between 1 ms and 10 ms.

It is especially beneficial when the light incident to the printing substrate at one position is controllable in its intensity and exposure duration for each laser light source independently of the other laser light sources. For this purpose, a control unit may be provided that is independent from or integrated in the machine control of the printing press. By controlling the laser light source parameters, it is possible to regulate the energy input at various positions of the printing substrate. An energy input may then be adapted to the coverage of the printing substrate at the positions in question on the printing substrate. Moreover, it is also beneficial to furnish the print unit according to the present invention with a number of laser light sources, so that light from at least two radiant energy sources is incident at one position on the printing substrate. On the one hand, this may be a question of partially overlapping light beams, and, on the other hand, of completely overlapping light beams. The maximum output power required of one individual laser light source is then less. Also, a redundancy is provided should one laser light source fail.

The printing press according to the present invention may be a direct or indirect planographic press, a lithographic press, offset press, flexographic press, or the like. On the one hand, the position where the light is incident to the printing substrate along its path through the printing press, may be downstream from the last printing nip of the last print unit of the number of print units, thus downstream from all printing nips. On the other hand, the position may also be downstream from a first printing nip and upstream from a second printing nip, thus at least between two print units. The printing press may be a sheet-processing or a web-processing press. A sheet-processing printing press may have a sheet feeder, at least one print unit, optionally a surface-finishing unit (punching unit, varnishing system or the like) and a sheet delivery unit. A web-processing printing press may include an automatic reelchange, a number of print units that print on both sides of the printing substrate web, a dryer, and a folder.

BRIEF DESCRIPTION OF THE DRAWINGS

Further advantages, advantageous embodiments and refinements of the present invention are described on the basis of the following figures, as well as their descriptions, in which.

DETAILED DESCRIPTION

Figure 1:
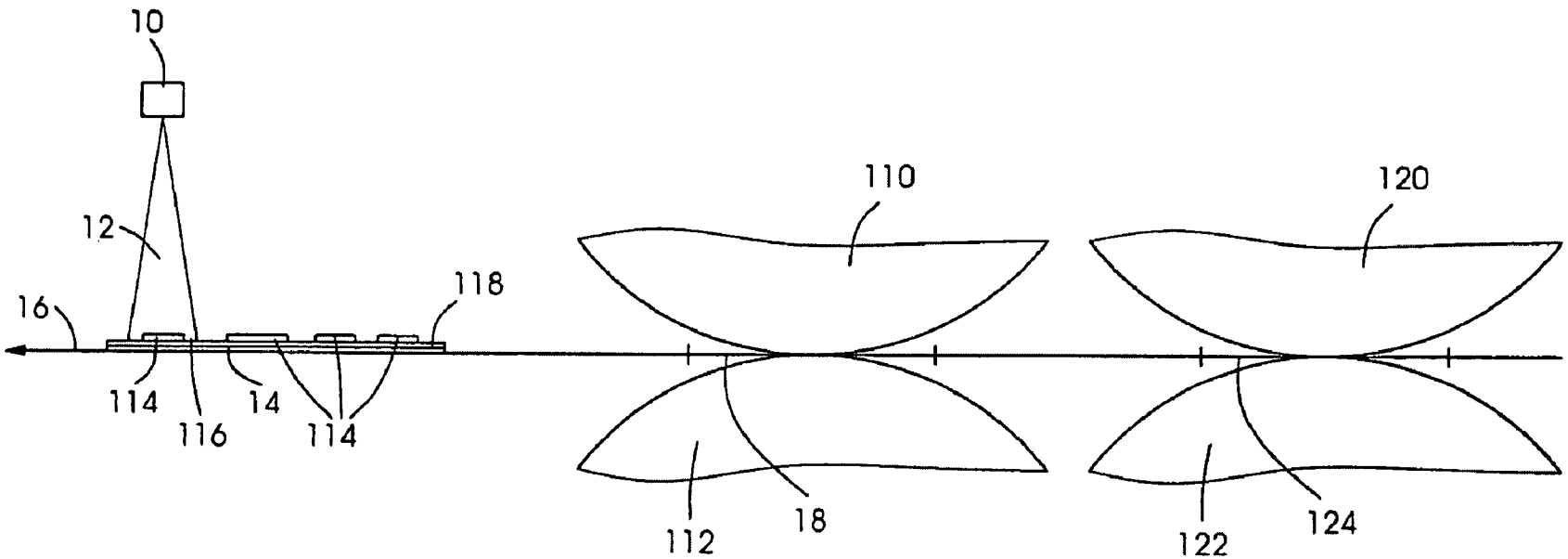
FIG. 1 shows a schematic representation for elucidating a specific embodiment of the drying method according to the present invention.

FIG. 1 shows a schematic representation for elucidating a specific embodiment of the drying method according to the present invention. A radiant energy source 10, in particular a laser, preferably a diode laser or solid-state laser, is configured within a planographic printing press in such a way that light 12 emitted by it is incident to a printing substrate 14 along its path 16 through the planographic printing press at a third position 116, which is situated downstream from a first position 18, in this case a printing nip. While in FIG. 1, printing substrate 14 is shown exemplarily in a sheet shape, the printing substrate may also be guided in a web shape through the planographic printing press. The orientation of path 16 of printing substrate 14 is characterized by an arrow. The path shown here is linear, but is not restricted thereto, and may likewise take a generally curve-shaped or non-linear course, in particular a circular arc. First position 18, here the printing nip, is defined in the embodiment shown in FIG. 1 by the co-action of printing cylinder 110 and of an impression cylinder 112, in which printing ink is transferred to the printing substrate during operation of the printing press. Depending on the special printing method employed in the planographic printing press, printing cylinder 110 may be a printing-form cylinder or a blanket cylinder. At a second position 124 disposed upstream from first position 18 along path 16, a treatment agent 118, in particular an infrared absorber, as already described in greater detail above, is applied to a printing substrate 14 when printing substrate 14 passes the third position. Second position 124 is defined by the co-action of an engraved roller 120, which transports treatment agent 118 to printing substrate 14, and a guide roller 122. In the situation in accordance with FIG. 1, printing ink 114, in particular solvent-containing printing ink, is shown on printing substrate 14. Light 12 emitted by radiation source 12 is incident in a beam or carpet-shape to printing substrate 14 at third position 116. Treatment agent 118, in particular the infrared absorber within this third position 116 is able to absorb energy from light 12, enabling printing ink 114 to be dried. By advantageously selecting a wavelength that is not resonant to the absorption wavelengths of water, an absorption in printing substrate 14 is reduced in a further refinement of the present invention.

Figure 2:
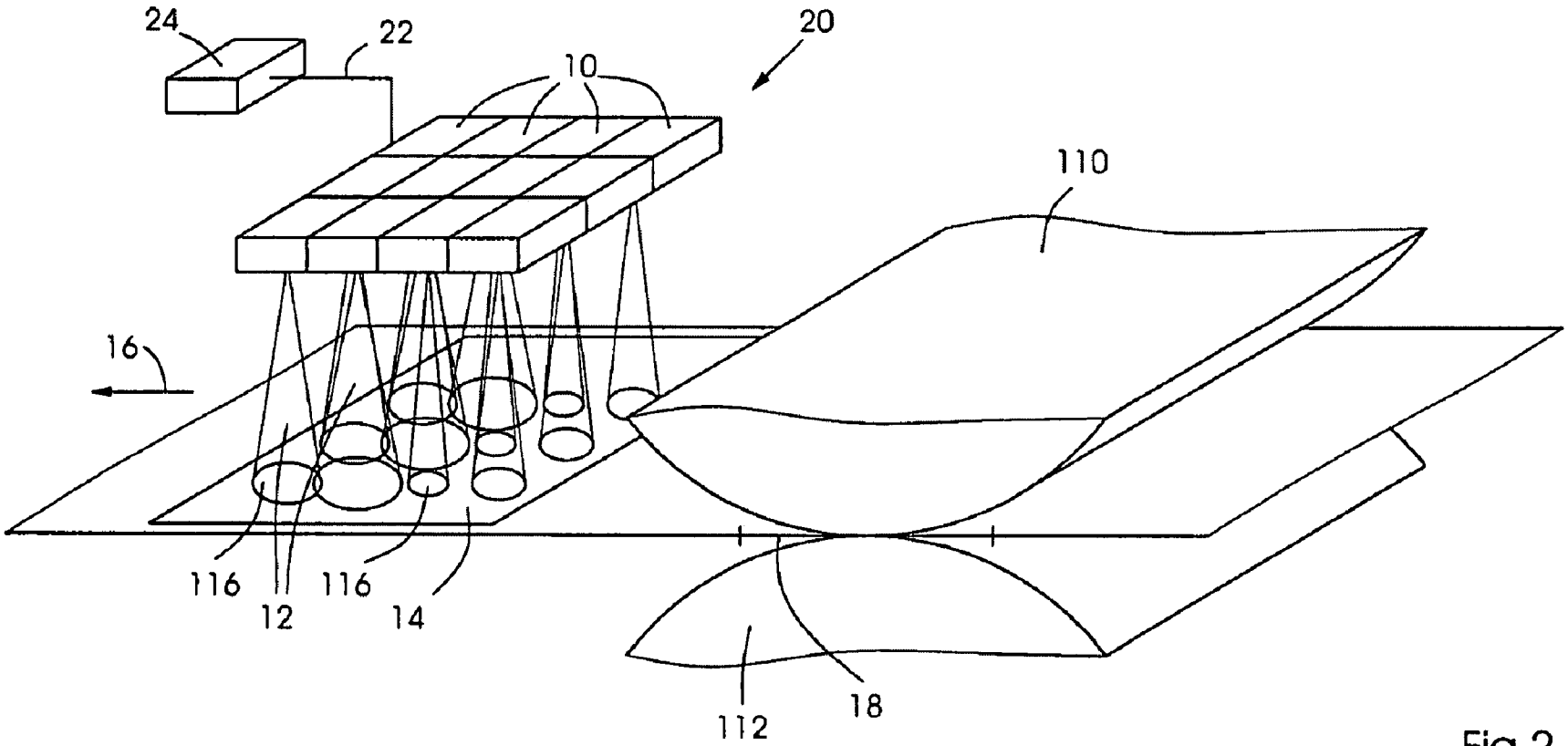
FIG. 2 shows a schematic representation of an advantageous refinement of an embodiment of the method according to the present invention.

FIG. 2 is a schematic representation of an advantageous refinement of an embodiment of the method according to the present invention. A field 20 of radiant energy sources 10 is sketched exemplarily, in this case, three times four, thus twelve radiant energy sources 10. Besides two-dimensional field 20 shown here, a one-dimensional field or a one-dimensional row, oriented over the width of printing substrate 14, may also be provided. A two-dimensional field, as also a three-dimensional field, whose light is incident to printing substrate 14 in a two-dimensional distribution, has, inter alia, the advantage of achieving a rapid drying in that a group of positions in one column of field 20 is irradiated in parallel or simultaneously. Consequently, the velocity with which the printing substrate moves past radiant energy sources 10 may be higher than when working with an only one-dimensional field. Field 20 may also have a different number of radiant energy sources 10. Light 12 is supplied to printing substrate 14 from each of the number of radiant energy sources 10. Third positions 116, where light 12 impinges on printing substrate 14, which follows a path 16 through the planographic printing press, are disposed downstream from a printing nip 18, defined by a printing cylinder 110 and an impression cylinder 112. In this context, individual third positions 116 may partially coincide, as shown in FIG. 2 for the front row of radiant energy sources 10, or, essentially, even completely overlap. Assigned to field 20 of radiant energy sources 10 is a control device 24, with which control signals may be exchanged via a connection 22. Field 20 may be driven by control device 24 in such a way that energy is input in accordance with the quantity of printing ink at third position 116 on printing substrate 14.

Figure 3:
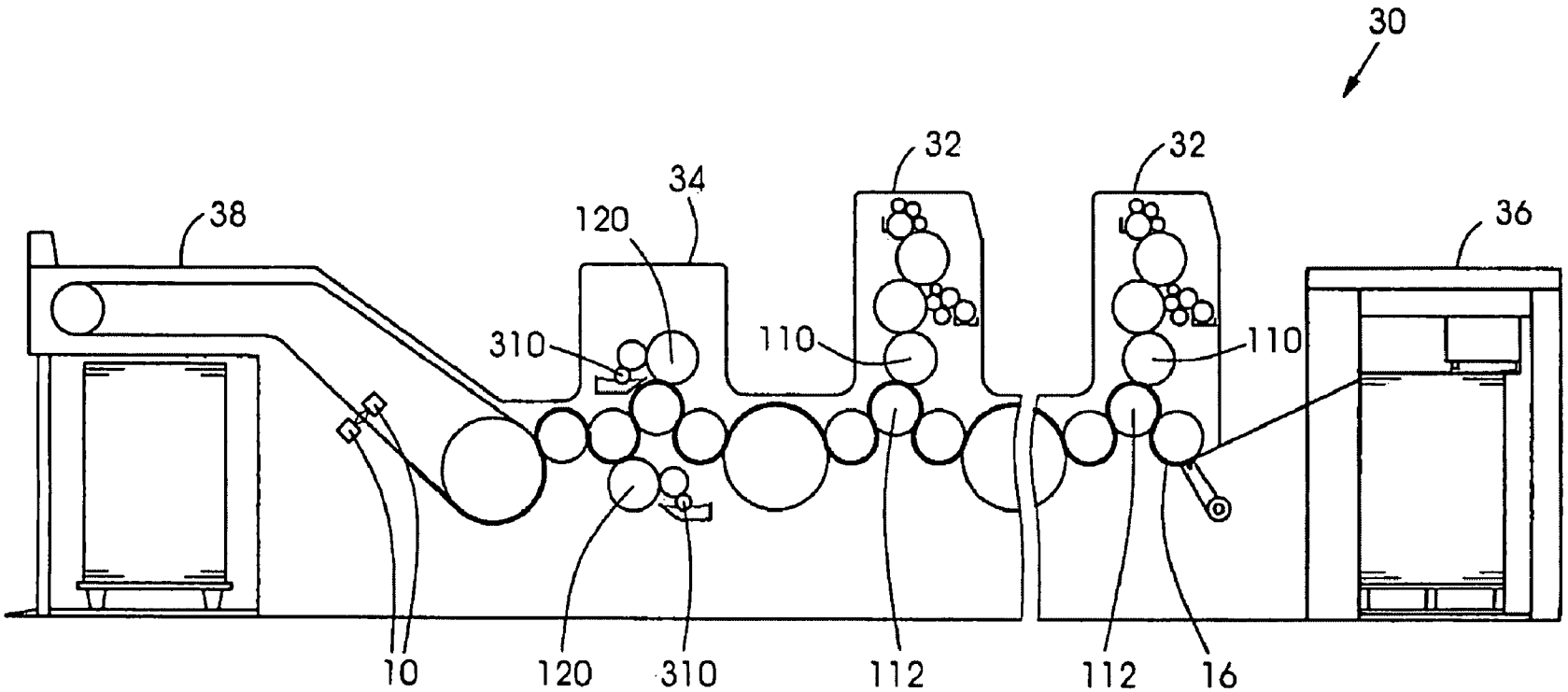
FIG. 3 shows an embodiment of a printing press according to the present invention, including a conditioning apparatus disposed downstream from the print units, and a drying device.

FIG. 3 relates schematically to an embodiment of a printing press 30 according to the present invention (front-side and back-side printing press), including a conditioning apparatus 34 disposed downstream from print units 32, and a drying device, here radiant energy sources 10, particularly suited for implementing the method of the present invention. Printing press 30 has a feeder 36, a plurality of print units 32 (two are shown here), a conditioning apparatus 34, and a delivery unit 38. The sheet-shaped printing substrate is moved along path 16 through printing press 30. Each print unit 32 includes an inking system and a damping unit and, in the printing nip formed by assigned printing cylinder 110 and impression cylinder 112, through which path 16 runs, applies printing ink, in particular solvent-containing printing ink, to the printing substrate. Between print units 32 shown in FIG. 3, an inverter may be provided, so that a printing substrate is able to be processed on both sides in printing press 30. On its path 16, printing substrate finally arrives in conditioning apparatus 34. In the embodiment shown, the conditioning apparatus has two engraved rollers 120, which contact the printing substrate from one side each, so that treatment agent, in particular infrared absorber, is applied on both sides. The treatment agent, in particular infrared absorber, is drawn by a dip roller 310 from a reservoir and transferred to the printing substrate over a large surface area. In other words, in one embodiment, the conditioning apparatus may have components that are similar or identical to components in a typical varnishing system, so that the treatment agent is fed and applied to the printing substrate as uniformly as possible. The conditioning apparatus may be designed independently of the print unit or units. In the embodiment shown here in FIG. 3, the drying device is configured in delivery unit 38: The printing substrate is dried on both sides by illuminating it with light from radiant energy sources 10, in that the treatment agent, in particular the infrared absorber, promotes the drying process, in particular the energy absorption.

Figure 4:
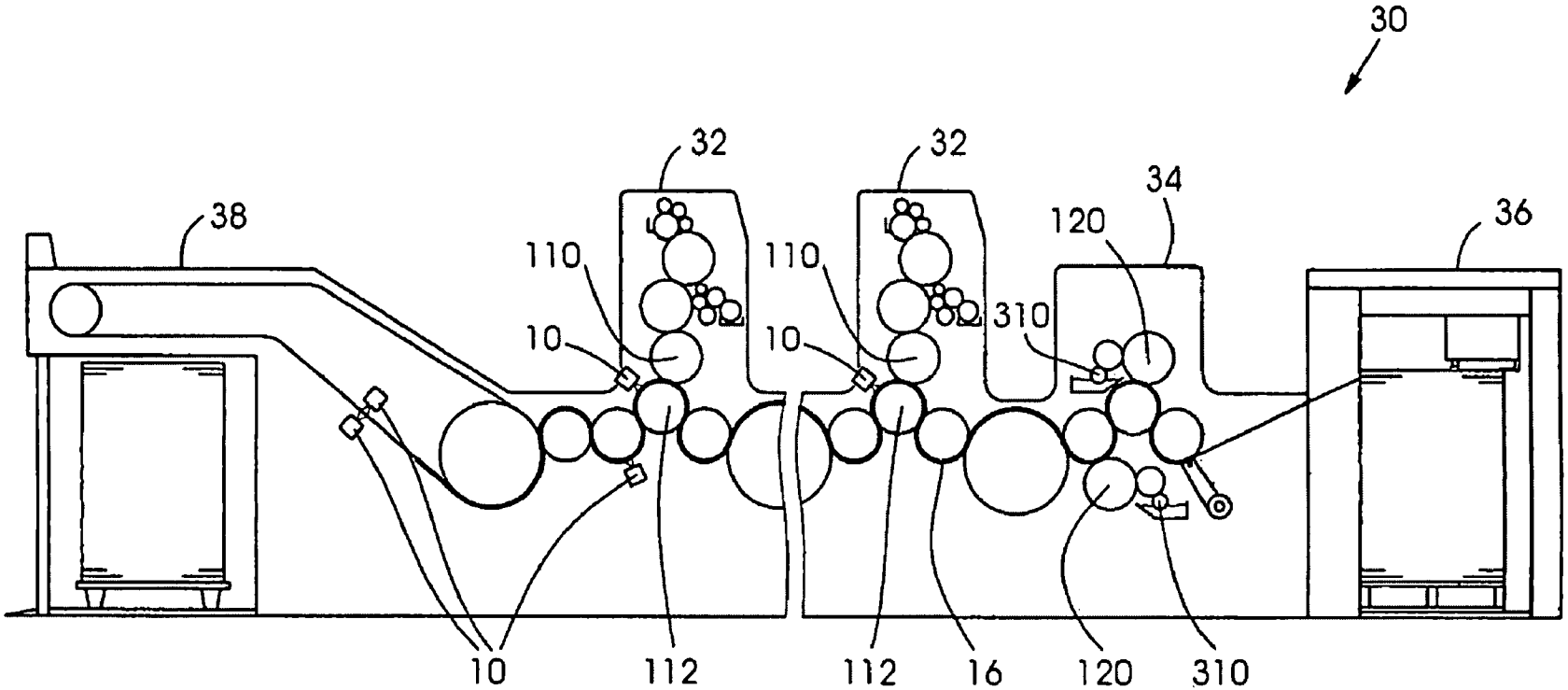
FIG. 4 shows an embodiment of a printing press according to the present invention, including a conditioning apparatus disposed upstream from the print units, and a drying device.

FIG. 4 schematically shows an embodiment of a printing press 30 according to the present invention (front-side and back-side printing press), including a conditioning apparatus 34 disposed upstream from print units 32, and a drying device, here radiant energy sources 10, which may be situated at various positions in printing press 30. Printing press 30 has a feeder 36, a conditioning apparatus 34, a plurality of print units 32 (two are shown here), and a delivery unit 38. The sheet-shaped printing substrate is moved along path 16 through printing press 30. After being first conveyed from feeder 36, on its path 16 through printing press 30, the printing substrate arrives in conditioning apparatus 34. In the embodiment shown, conditioning apparatus 34 has two engraved rollers 120, which contact the printing substrate from one side each, so that treatment agent is applied on both sides. The treatment agent is drawn by a dip roller 310 from a reservoir and transferred to the printing substrate over a large surface area. Each print unit 32 includes an inking system and a damping unit and, in the printing nip formed by associated printing cylinder 110 and impression cylinder 112, through which path 16 runs, applies printing ink, i.e., solvent-containing printing ink, to the printing substrate. Between print units 32 shown in FIG. 4, an inverter may be provided, so that a printing substrate is able to be processed on both sides in printing press 30.

In the specific embodiment shown here in FIG. 4, three variants of the configuration of the radiant energy sources used for drying are depicted: The three variants are only shown in one figure for the sake of simplifying the representation of the present invention. Printing presses in accordance with the present invention may also have these three variants individually, or in combinations of two or all three at the same time. In a first variant, radiant energy sources 10 may be positioned directly downstream from printing nips formed by printing cylinder 110 and impression cylinder 112 in a print unit 32. Already upon transfer of printing ink to the printing substrate, radiant energy sources 10 illuminate the printing substrate on impression cylinders 112. In a second variant, radiant energy sources 10 may be configured in last print unit 32 in such a way that at least one first radiant energy source 10 illuminates a first side of the printing substrate, and at least one second radiant energy source 10 illuminates a second side of the printing substrate. This configuration may be implemented, for example, in that a radiant energy source 10 illuminates the printing substrate on impression cylinder 112, and a further radiant energy source 10 illuminates the printing substrate on the cylinder situated directly downstream from impression cylinder 112 (see FIG. 4). In a third variant, radiant energy sources 10 are configured in such a way in delivery unit 38 that the printing substrate is illuminated on both sides with light from radiant energy sources 10. The drying of the printing substrate is accelerated in that the treatment agent promotes the drying process.

REFERENCE NUMERAL LIST

10 radiant energy source
12 light
16 path
14 printing substrate
18 first position
110 printing cylinder
112 impression cylinder
114 printing ink
116 third position
118 treatment agent
120 engraved roller
122 guide roller
124 second position
20 field of radiant energy sources
22 connection for transmitting control signals
24 control unit
30 printing press
32 print unit
34 conditioning apparatus
36 feeder
38 delivery unit
310 dip roller

What is claimed is:

1. A method for drying a printing ink on a printing substrate in a printing press comprising the steps of:

using at least one printing ink to print on the printing substrate at a first position of a path, the printing substrate being moved along the path through the printing press; and applying a treatment agent at a second position of the path on the printing substrate to accelerate drying of the printing ink on the printing substrate; and wherein the printing substrate is dried by the action of radiant energy at a chronologically later point in time from the using and applying steps at least one third position of the path; and wherein at least the third position of the path, the printing substrate is illuminated with light from a narrow-band radiant energy source, and wherein the treatment agent includes an infrared absorber with an absorption wavelength resonant to the wavelength of the light.

2. The drying method as recited in claim 1 wherein the light has a wavelength of between 700 nm and 3000 nm.

3. The drying method as recited in claim 1 wherein the wavelength of the light is not resonant to the absorption wavelengths of water.

4. The drying method as recited in claim 1 wherein the printing substrate passes the first position chronologically before the second position, and the treatment agent is applied in the form of a coating.

5. The drying method as recited in claim 1 wherein the printing substrate passes the first position chronologically after the second position, and the treatment agent is applied in the form of a primer coating.

* * * * *